US006123057A

United States Patent [19]

Göras et al.

[11] Patent Number: 6,123,057

[45] Date of Patent: Sep. 26, 2000

[54] ARRANGEMENT AND PROCESS FOR COMMUNICATION BETWEEN AN IGNITION MODULE AND CONTROL UNIT IN A COMBUSTION ENGINE'S IGNITION SYSTEM

[75] Inventors: Anders Göras; Jan Nytomt, both of Åmål, Sweden

[73] Assignee: Mecel AB, Sweden

[21] Appl. No.: 09/101,963

[22] PCT Filed: Nov. 17, 1997

[86] PCT No.: PCT/SE97/01930

§ 371 Date: Jul. 20, 1998

§ 102(e) Date: Jul. 20, 1998

[87] PCT Pub. No.: WO98/22708

PCT Pub. Date: May 28, 1998

[30] Foreign Application Priority Data

Nov. 18, 1996 [SE] Sweden ..... 9604232

[51] Int. Cl.[7] ..... F02P 5/00

[52] U.S. Cl. ..... 123/406.2; 123/406.27; 123/643; 701/102

[58] Field of Search ..... 123/643, 406.14, 123/406.19, 406.2, 406.27, 406.26, 406.65; 701/102

[56] References Cited

U.S. PATENT DOCUMENTS

| | | | |
|---|---|---|---|
| 4,856,489 | 8/1989 | Ozawa | 123/643 |
| 4,870,587 | 9/1989 | Kumagai | 123/643 |
| 5,598,821 | 2/1997 | Terata et al. | 123/406.27 |

*Primary Examiner*—John Kwon
*Attorney, Agent, or Firm*—Ostrolenk, Faber, Gerb & Soffen, LLP

[57] ABSTRACT

An arrangement and a process for communication between an ignition module (ICM) mounted on an engine and a control unit (ECM). The ignition module includes detection circuits and signal processing stages in order to determine at least one combustion related parameter from detected ionization currents in the combustion chamber (22). The control unit (ECM) communicates with the ignition module via at least one bi-directional communication wire ($K_{CQ}$ or $K_{KI}$). Via the communication wire the control unit activates the detection in the ignition module, and the ignition module sends a signal corresponding to the magnitude of the detected parameter to the control unit on the same communication wire. Activation and transfer of parameter data is conducted sequentially over the communication wire.

8 Claims, 3 Drawing Sheets

ARRANGEMENT AND PROCESS FOR COMMUNICATION BETWEEN AN IGNITION MODULE AND CONTROL UNIT IN A COMBUSTION ENGINE'S IGNITION SYSTEM

BACKGROUND OF THE INVENTION

The present invention refers to an arrangement and process for communication between an ignition module mounted on an engine and the control unit in a combustion engine's ignition system.

STATE OF THE ART

In ignition systems with detection of the degree of ionisation in the combustion chamber, preferably via the spark plug gap, a number of combustion related parameters can be detected via the ionisation current. In the systems which are used in motor vehicles, e.g. in the SAAB 2.3 liter four-cylinder petrol engines, an amplified analogue signal in relation to the degree of ionisation is sent from an ignition module mounted on the engine, or ignition cassette, up to the ignition system's control unit. The knock intensity is then detected in the control unit via the filtering out of a representative frequency content in relation to the knock in the amplified analogue ionisation signal.

One risk with these systems is that the analogue information is sensitive to interference, and that a great deal of the information which exists in the ionisation signal can be lost during the amplification or signal processing before the signal is sent to the control unit.

One preference is therefore that the determination of the different combustion related parameters should be conducted as close to the engine as possible, i.e. in the ignition module/ignition cassette. Such a partitioning of the system, however, sets requirements on the transfer of information and the activation of the different detection processes, which detection processes must be activated at different times and in relation to the engine's actual load and speed. A natural arrangement would therefore be to introduce an individual signal wire between the control unit and ignition module for each of the different parameter values which are to be transferred, and individual signal wires for activation/triggering of the detection functions.

The invention has the objective of reducing the number of wires between an ignition module mounted on the engine and its control unit, where the ignition module can locally determine at least one of the parameters related to combustion, based on the detected degree of ionisation in the combustion chamber. By reducing the number of wires the ignition system can be made more reliable with the minimisation of the number of contact points, also achieving a reduction of the cabling costs. This is very important during the installation of electronics and additional cabling, above all in the exposed environment in an engine compartment of a motor vehicle.

A further objective is to enable a standardisation of the ignition module, where the ignition module contains all the means for determining at least one signal related to the combustion quality and one signal related to the knock intensity, but where all corrections and initiations of the detection in accordance with predetermined algorithms are determined in the control unit. Each ignition system can hereby be easily adjusted to different types of engines by modification in the control unit, but where the ignition module consists of a standardised unit in the ignition system. The combustion process can differ between different combustion engines, and also the requirements for combustion quality and permissible knock level can differ between different types of applications. This makes it necessary to adjust the detection strategies to different types of engines.

Yet another objective with a favourable design is that at least two signal processing stages can be activated at least partially in parallel and transfer at least partially in parallel different combustion related parameters on the respective communication wire.

SUMMARY

An arrangement and process in accordance with the present invention for accomplishing the foregoing and other objects includes providing a cable for communication between the control unit and the ignition module, the cable containing at least one individual trigger wire for each primary switch in the ignition module and one first bi-directional communication wire for each ignition module, the first bi-directional communication wire being used to activate a signal processing unit and to transfer information concerning the first combustion related parameter from the ignition module to the control unit. The information is obtained via a detection circuit and a signal processing unit as a function of the combustion process, the activation and transfer of information via the communication wire being sequential.

By means of the arrangement and process in accordance with the invention it is possible for both activation of an ion current analysis, and transfer of a combustion related parameter determined from the ion current analysis, using only one bi-directional communications wire. This reduces the number of wires and contact points between the control unit and ignition module, which increases reliability and reduces the cost of the ignition system. Each wire and contact point constitute a potential fault source.

Other special features and advantages of the invention are indicated in the subsequent description of a design example with reference to the drawings.

PREFERRED EMBODIMENT(S)

Figure 1:
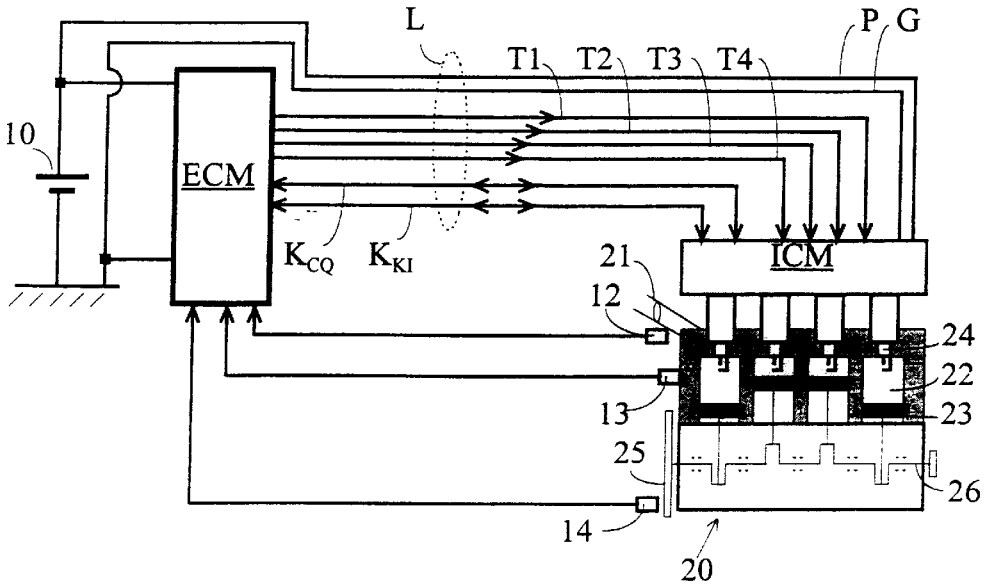
FIG. 1 shows a combustion engine with an ignition module mounted on the engine and a control unit arranged at a distance from the engine.

The invention is applied on combustion engines 20 of the Otto type, see FIG. 1, equipped with at least one ignition module mounted on the engine, ICM (Ignition Control Module), and a control unit, ECM (Engine Control Module). The control unit is placed in the motor vehicle, preferably mounted at a distance from the engine, either on the cowl wall in the engine compartment or protected inside the vehicle's coupe. The combustion engine is equipped with a number of sensors, for example:

One load sensor 12, arranged in the induction pipe 21 (alternatively a throttle position sensor).

One engine temperature sensor 13.

One engine position sensor 14, arranged by the engine's flywheel 25, where a number of cogs on the flywheel in an inherently known manner generate pulses from the sensor 14. A number of cogs are shaped differently, whereby the engine position, i.e. the rotational positions of the crankshaft 26 and thereby also the position of the pistons 23 in the engine's combustion chamber 22 can be determined.

The sensors 12–14 are connected to the control unit ECM, whereby not only ignition but also the fuel supply can be regulated depending on the detected engine load, engine temperature, position and speed of the engine. The control unit ECM controls, depending on the detected engine parameters, via trigger signal wires T1–T4 when the ignition module ICM shall generate an ignition spark. The trigger signal wires shown in the design example are four individual trigger signal wires for each ignition coil. The ignition coils are preferably directly connected on respective ignition plugs (see FIG. 2) in a four-cylinder engine. The ignition module is also supplied with current via a two-wire P,G connected to both poles of the power source. The control unit ECM also receives its current via a power source, preferably at battery 10. In accordance with the invention the cabling L between the control unit ECM and the ignition module ICM also contains at least one bi-directional communications wire, $K_{KI}$ or $K_{CQ}$.

Figure 2:
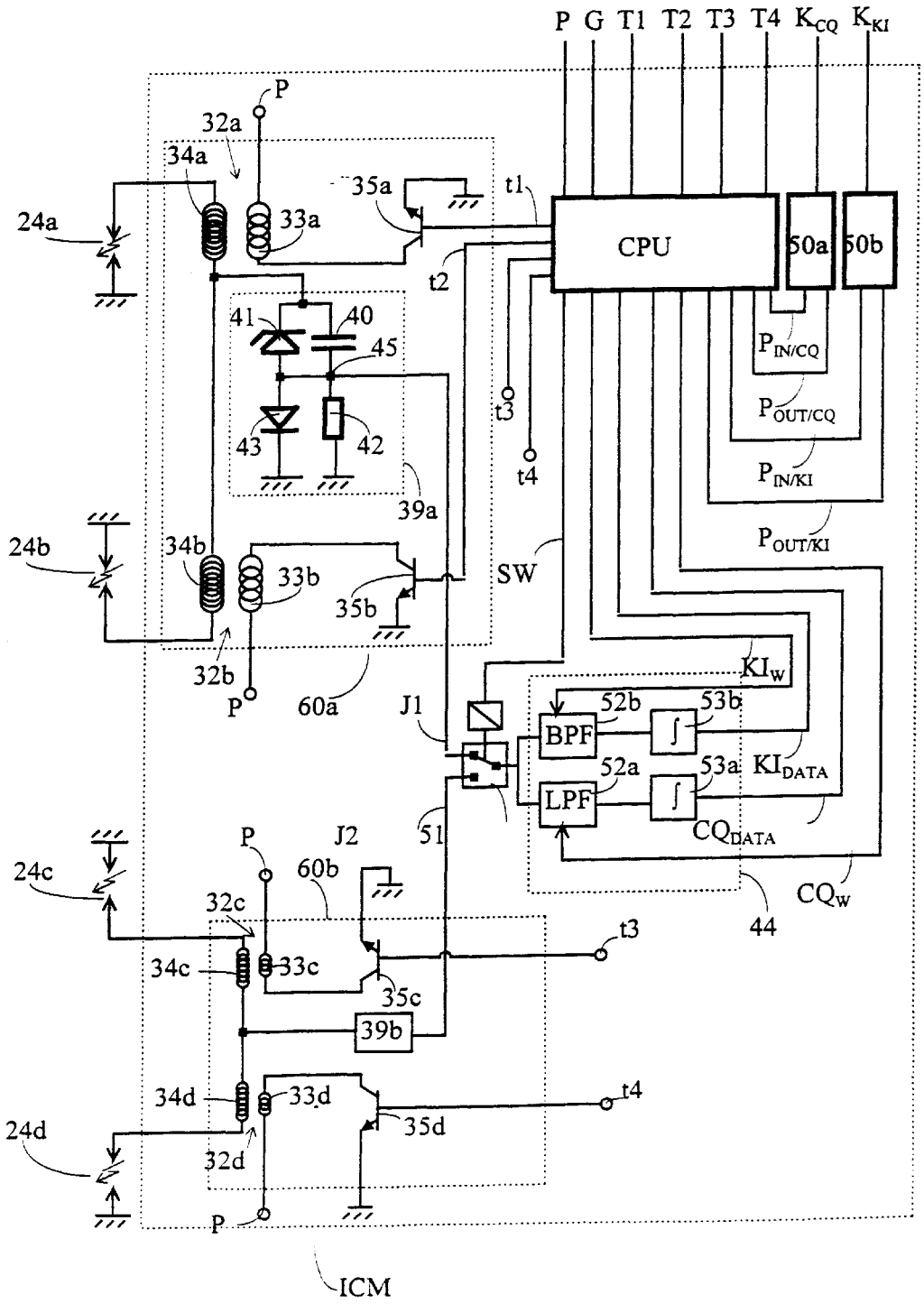
FIG. 2 shows an ignition module for a four-cylinder Otto-engine.

FIG. 2 shows the structure of the ignition module, ICM, for a four-cylinder Otto-engine. In the design example shown a detection circuit 39*a* is used for two ignition circuits 32*a*–33*a*–34*a*–35*a*, and 32*b*–33*b*–34*b*–35*b*. These ignition circuits generate the ignition spark in the spark plugs 24*a* and 24*b*, arranged in two different cylinders where the pistons have a phase displacement of 180 crankshaft degrees. The unit 60*a*, with two ignition circuits and one common detection circuit 39*a*, is identical with the other unit 60*b*, which generates the ignition spark in the spark plugs 24*c* and 24*d*.

The trigger signals T1–T4 go via a processor CPU to circuit breakers or primary switches 35*a* and 35*b* in the unit 60*a* and circuit breakers or primary switches 35*c* and 35*d* in the unit 60*b*, via the signal wires t1–t4. In each cylinder 22 at least one spark plug 24*a*–24*d* is arranged. The function is described in more detail with reference to the generation of an ignition spark in the spark plug 24*a*. The ignition voltage is generated in an ignition coil 32*a* with primary winding 33*a* and secondary winding 34*a*. The primary winding 33*a* is in one end connected to a voltage source, P, and an electrically controlled circuit-breaker 35*a* is arranged in its earth connection. In that the processor on the trigger outlet t1 switches the circuit-breaker 35*a* to a conductive state, a current begins to flow through the primary winding 33*a*, and when the current is interupted a step-up transformed ignition voltage is induced in the normal manner in the ignition coil's 32*a* secondary winding 34*a* and an ignition spark is generated in the spark plug gap. When the current is to be turned on and when the current is to be switched off by the circuit-breaker 35*a*, so-called dwell-time regulation, is controlled in accordance with the pre-stored ignition angle map in the control unit's memory depending on the engine parameters in question. The dwell-time regulation ensures that the necessary primary current has time to develop and that the ignition spark is generated at the ignition point which is required for the load case in question.

One end of the secondary is connected to the spark plug 24*a* and in its other earth connected end there is a detection circuit 39*a* which detects the degree of ionisation in the combustion chamber. The detection circuit includes a voltage accumulator, here in the form of a chargeable condenser 40, which applies a bias voltage over the spark plug gap with an essentially constant measuring voltage. The condenser corresponds to an equivalent solution to the design example shown in EP,C,188180, where the voltage accumulator is an enhanced/step-up transformed voltage from the charging circuit in a capacitive ignition system. In the design example shown in the figure the condenser 40 is charged up to a voltage level given by the Zener diode's 41 breakdown voltage when the ignition voltage pulse is induced in the secondary winding 34*a*. This breakdown voltage can lie somewhere between 80–400 volts. The Zener diode breaks down when sufficient current has been generated for the condenser to be charged up to a voltage level corresponding to the Zener diode's breakdown voltage. An inverse protective diode 43 is arranged in parallel with the measuring resistance 43 which correspondingly provides protection from voltages with inverse polarity.

Over the measuring resistance 42 the current which goes in circuit 24*a*–34–40/40–42-earth can then be detected, which current depends on the conductivity of the gases in the combustion chamber, and which conductivity is proportional to the degree of ionisation in the combustion chamber.

In that the measuring resistance 42 is connected closest to earth, only one connection is required in the measuring point 45 to a signal processing unit 44, which signal processing unit measures the voltage over the resistance 42 and in the measuring point 45 in relation to earth. By analysing the current through, or alternatively the voltage over the measuring resistance, it is possible to detect knocking and pre-ignition, and as described in U.S. Pat. No. 4,535,740 it should be possible to detect the actual mixing ratio of air and fuel during certain operating cases by measuring how long the ionisation current exceeds a certain level.

The signal processing unit 44 shown produces a signal corresponding to the combustion quality, CQ/Combustion Quality, and a signal corresponding to the knock intensity, KI/Knock Intensity, in two parallel signal processing stages 52*a*,53*a* and 52*b*,53*b*. A representative value in relation to a knocking condition is obtained in a signal processing stage by extracting out the typical frequency content for a knocking condition. This is done in a band-pass filter/BPF, 52*b*, where the band-pass filter's centre frequency is set to the knock frequency, which knock frequency is dictated by the engine geometry. For a conventional 2 liter four-cylinder Otto-engine the centre frequency can typically lie at some 5 kHertz. Thereafter the band-pass filtered signal is rectified and integrated in an integrator 53*b*. The signal, $KI_{DATA}$, which is obtained from the integrator 53*b* will therefore be proportional to the knock intensity.

A representative value for the combustion quality is obtained in a similar manner in a second signal processing stage, by means of blocking out high frequency components in the ion current signal. This is done in a low-pass filter 52*a*. Thereafter the low-pass signal is integrated in an integrator 53*a*. The signal, $CQ_{DATA}$, obtained from the integrator 53*a* will therefore be proportional to the combustion intensity, which can be used as a measure of the combustion quality.

Figure 4:
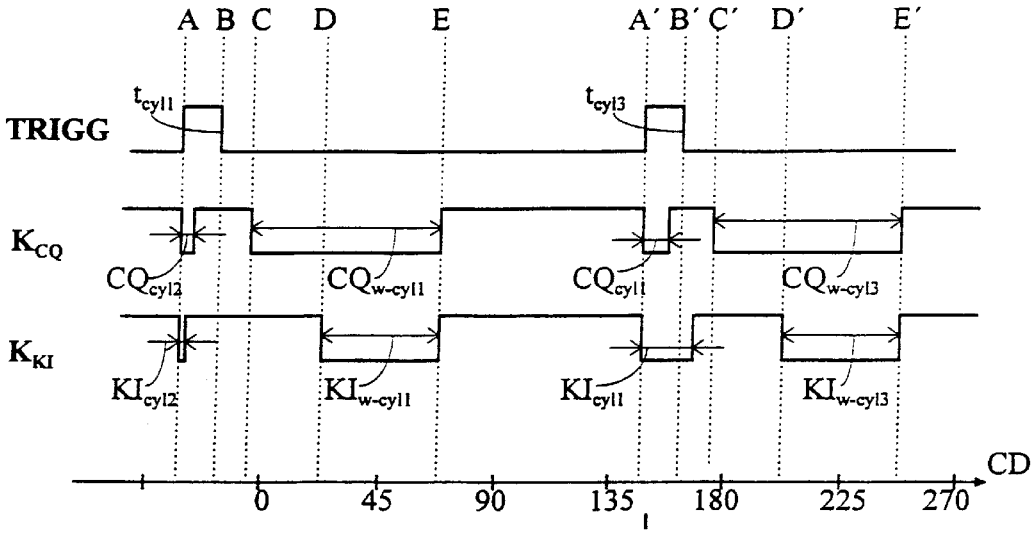
FIG. 4 shows a signal status diagram for trigger signal, combustion quality signal, and knock signal in relation to the position of the engine (crankshaft degrees, CD).

The measuring window signals $CQ_w$ and $KI_w$ are sent to the respective filters 52*a*/52*b* from the processor when the filtering in respective filters 52*b* and 52*a* is to be initiated. The measuring window signals activate the filter in the measuring window, which measuring window is controlled by the control unit, ECM, in a manner which is described in more detail in connection with FIG. 4.

Since the signal processing unit 44 contains relatively expensive components a change-over switch 51 is used, which depending on a signal on a wire SW from a logic circuit switches between the detection circuit 39*a* in the unit 60*a* and a corresponding detection circuit 39*b* in the unit 60*b*. The change-over switch 51 is schematically reproduced in the figure as a relay controlled circuit-breaker, which with conventional IC-circuits can be realised with a MUX (multiplex)-circuit, controlled by the processor CPU. This is conducted depending on the trigger signals from the control unit ECM. When the ignition sequence has been determined the change-over switch 51 begins to switch so that either the signal on wire J1 or J2 is connected to the signal processing unit 44 depending on in which cycle combustion takes place. With the ignition sequence 1-3-4-2 the change-over switch first stands in the position shown in the figure when cylinder 1 fires, after which the change-over switch changes during the time cylinder 3 and 4 fire, in order to return to the position shown when cylinder 2 fires. This assumes that spark plug 24*a* is in cylinder 1, 24*b* in cylinder 2, 24*c* in cylinder 3, and 24*d* in cylinder 2.

If cylinder identification, i.e. firing order determination, takes place during start of the engine with ion current detection, the firing is generally generated in both cylinders where the pistons simultaneously reach top dead centre, when one cylinder is at the end of the exhaust phase and the other cylinder is in the end phase of compression of the fuel-air mixture. The ionisation signal becomes considerably higher from the cylinder where combustion occurs, which is used to determine the firing order. In order to ensure that the firing order is determined correctly some 10 confirmative determinations of the firing order are required. If a change-over switch 51 in accordance with FIG. 2 is used the change-over switch must stand in a fixed position until the firing order has been determined. This implies that a number of combustions in the engine must be activated before the firing order is unequivocally determined, since only combustions from two of the engine's four cylinders provide the basis for the determination of the firing order. Once the firing order has been determined a spark is only generated in the cylinder where the piston reaches the end of the compression stroke, and the change-over switch 51 begins to adjust to the cylinders which are in firing position.

The processor contains an A/D converter, where the analogue signals $KI_{DATA}$ and $CQ_{DATA}$ are converted to digital signals, preferably pulse width modulated (PWM-modulation). In accordance with the invention the ignition module's processor CPU sends the signal $KI_{DATA}$ corresponding to the knock intensity via a adaptation matching circuit 50*b*, by putting out a digital signal on the wire $P_{OUT/KI}$ having a pulse width which is proportional to the analogue integrated value from the integrator 53*b*. In the same manner the ignition module's processor CPU sends the analogue signal $CQ_{DATA}$ corresponding to the combustion quality via a an adaptation or matching circuit 50*a* by putting out a digital signal on the wire $P_{OUT/CQ}$ having a pulse width which is proportional to the integrated value from the integrator 53*a*.

Figure 3:
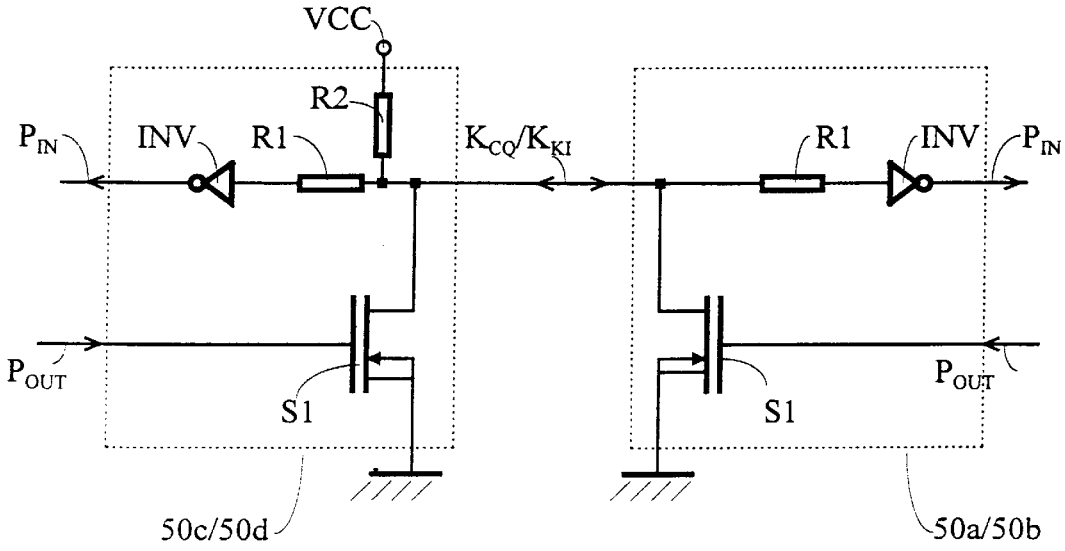
FIG. 3 shows matching circuits, interface, for bi-directional communication in accordance with the invention.

The adaptation or matching circuits 50*a*/50*b* and 50*c*/50*d* which are included in the ignition module and control modules respectively are indicated in FIG. 3, and this type of matching unit is located at each end of the communication wires $K_{CQ}$ and $K_{KI}$, i.e. matching units 50*c*/50*d* in the control unit and matching units 50*a*/50*b* in the ignition module. The matching circuit is of the active-low type, where the signal is present when the signal level on the $K_{CQ}/K_{KI}$ wire is low. $K_{CQ}/K_{KI}$ is connected to a supply voltage/VCC via a resistance R2. With 5 volts logic the VCC lies at a voltage level of 5 volts. If, for example, the ignition module in its end activates its output $P_{OUT}$ then SI is reset to a conductive status, whereby $K_{CQ}/K_{KI}$ is connected to earth and assumes a low/active signal. The low status on $K_{CQ}/K_{KI}$ is detected by the control unit in the other end of the communication wire $K_{CQ}/K_{KI}$ via its signal input $P_{IN}$.

An inverter INV inverts the active low signal on $K_{CQ}/K_{KI}$ to an active high signal for the ECM and the CPU. The function of the matching units is described in more detail with reference to the signal status diagram shown in FIG. 4. At the point in time A the control unit ECM sends out a signal on the wire T1 which via the processor switches the primary switch 35*a* for cylinder 1 into a conductive status with a signal on the wire t1. This signal also initiates the processor in the ignition module to send up the value in the integrators 53*a* and 53*b* obtained from the previous combustion, which in FIG. 4 correspond to the pulse width $CQ_{cy12}$ and $KI_{cy12}$, obtained from the combustion in cylinder 2. The previous combustion has occurred in cylinder 2 in a four-cylinder engine with the firing order 1-3-4-2. The pulse widths on $CQ_{cy12}$ and $KI_{cy12}$ are preferably proportional to $CQ_{DATA}$ and $KI_{DATA}$ obtained from the two signal processing stages 52*a*,53*a* and 52*b*,53*b*.

At the point in time B the trigger signal on the wire T1 goes low which switches the primary switch into a non conductive status, whereby the spark is generated, which normally occurs a few crankshaft degrees/CD prior to the top dead centre. The top dead centre for cylinder 1 corresponds to 0 CD on the x-axis in FIG. 4. When combustion starts the detection of the combustion quality is initiated, which takes place at the point in time C controlled by the control unit by means of activating the measuring window, with the signal $CQ_{w\text{-}cy11}$. The control unit ECM activates its output $P_{OUT}$ which activates S1 to a conductive status, whereby $K_{CQ}/K_{KI}$ is connected to earth and assumes a low/active signal. The low signal in the communication wire $K_{CQ}$ is detected by the ignition module's processor CPU on the input $P_{IN/CQ}$, whereby the processor activates the filter 52*a* via the signal wire $CQ_w$.

The pressure oscillations typical for a knocking condition always occur at a later stage of the combustion. The control of the knock measuring window is conducted in a similar manner. When knocking can occur the knock detection is initiated, which takes place at the point in time D controlled by the control unit by activating the measuring window, with the signal $KI_{w\text{-}cy11}$. The control unit ECM activates its output $P_{OUT}$, which activates S1 to a conductive status, whereby the communication wire $K_{KI}$ is connected to earth and assumes a low/active signal.

The low signal on the communication wire $K_{KI}$ is detected by the ignition module's processor CPU on the input $P_{IN/KI}$, whereby the processor activates the filter 52*b* via the signal wire $KI_w$. At the point in time E the control unit ECM closes the measuring window for knock and combustion quality in that the respective output $P_{OUT}$ is deactivated, whereby $K_{KI}$ and $K_{CQ}$ assume a high non active signal.

The invention can be modified in a number of ways within the framework of attached claims. The matching circuits 50*a*/50*b* and 50*c*/50*d* in the ignition module and control unit can, instead of being of the active-low type, be of the active-high type. The parameters determined from the ionisation signal can be more than two or refer to other combinations of two at least partially parallel measurements. For example, a third signal, which depends on how long the ionisation signal has exceeded a predetermined or an engine parameter related signal level, can replace one of the given parameters CQ or KI in the design example, or alternatively supplement these.

The combustion engine can also have more or less than four cylinders, for example, 2, 6, 8 or 12 cylinders. In certain engines it is also possible to use more than one ignition module, for example in V-engines where an ignition module is arranged on respective cylinder banks.

The signal processing unit 44 can also be activated such that the initiation signal $CQ_w$ and $KI_w$ directly starts and concludes the integration in stages 53*a* and 53*b*. The resetting of the integrators can be handled by the CPU, for example dependent of $CQ_{DATA}$ and $KI_{DATA}$ being collected by the processor CPU. The invention can also be implemented in ignition systems where the control unit is arranged on the engine, but where a cable connects the control unit mounted on the engine with the ignition modules. The invention can also be used in capacitive ignition systems, where the primary switch 35*a*/35*b* discharges instead from a condenser via the primary winding.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. Arrangement for communication in an ignition system between at least one ignition module mounted on a combustion engine and a control unit physically separated from the ignition module and arranged at a distance from the ignition module, wherein the ignition module includes at least one ignition coil with a primary winding and a secondary winding, at least one detection circuit for detecting an ionization current in a spark plug gap connected to the secondary winding, and a signal processing unit connectable to the detection unit, the signal processing unit containing means to determine at least one combustion parameter from the detected ionization current, the ignition module including a primary switch connected to the ignition coil's primary winding by means of which primary switch the control unit controls the current through the primary winding and thereby induces an ignition voltage in the spark plug gap, the arrangement being characterized in that the control unit communicates with the ignition module via a cable containing at least, one individual trigger wire for each primary switch in the ignition module, and one first bi-directional communication wire for each ignition module where the first bi-directional communication wire is used to activate the signal processing unit from the control unit, and to transfer information concerning a first combustion related parameter from the ignition module to the control unit, which information is obtained via the detection circuit and the signal processing unit from the combustion process, and where activation and the transfer of information via the communication wire is sequential.

2. An arrangement in accordance with claim 1, wherein the cable further includes a second bi-direction wire for each ignition module, the first and second bi-directional communication wires being used to partially parallel activate two signal processing stages in the signal processing unit connected to the detection circuit, and transfer at least partially parallel information concerning a first and second combustion related parameter from the ignition module to the control unit, which information is obtained in the respective signal processing stages from the combustion process, and where activation and the transfer of information via a respective one of first and second communication wires is sequential.

3. An arrangement in accordance with claim 1 or 2, in which each of the first and second communication wires has a first end connected to the control unit via a first matching circuit and its other end connected to the ignition module via a second matching circuit.

4. An arrangement in accordance with claim 3, wherein each matching circuit contains a drive connection to the control unit and ignition module and a signal input to the control unit and ignition module, the drive connection on activation from the control unit and ignition module, respectively, via switch means, switching the signal status on the respective communication wire from a first signal level to a second signal level, and the signal input detecting the actual signal level on the respective communication wire.

5. An arrangement in accordance with claim 4, wherein the control unit via its drive connection for the respective communication wire activates a signal processing state in the signal processing unit.

6. Process for communication in an ignition system between at least one ignition module mounted on a combustion engine and one control unit physically separated from the ignition module and arranged at a distance from the ignition module, the ignition module including at least one ignition coil with a primary winding and a secondary winding, at least one detection circuit for detecting an ionization current in a spark plug gap connected to the secondary winding, and a signal processing unit connectable to the detection unit, the signal processing unit containing means determining at least one combustion parameter from the detected ionization current and the ignition module including a primary switch connected to the ignition coil's primary winding by means of which primary switch the control unit controls the current through the primary winding and thereby induces an ignition spark in the spark plug gap, the process comprising the steps of:

communicating between the control unit and the ignition module via at least one for each ignition module individual first bi-directional communication wires, the first bi-direction communication wire being used to activate the signal processing unit from the control unit for detection of a first combustion related parameter, and to transfer information concerning the first combustion related parameter from the ignition module to the control unit, the activation and the transfer of information being sequential and synchronous with the inducement of the ignition spark initiated by the control unit.

7. Process for communication in an ignition system between at least one ignition module mounted on a combustion engine and one control unit physically separated from the ignition module and arranged at a distance from the ignition module, the ignition module including at least one ignition coil with a primary winding and a secondary winding, at least one detection circuit for detecting an ionization current in a spark plug gap connected to the secondary winding, and a signal processing unit connectable to the detection unit, the signal processing unit containing means determining at least one combustion parameter from the detected ionization current and the ignition module including a primary switch connected to the ignition coil's primary winding by means of which primary switch the control unit controls the current through the primary winding and thereby induces an ignition spark in the spark plug gap, the process comprising the steps of:

communicating between the control unit and the ignition module via at least one for each ignition module individual first bi-directional communication wires, the first bi-direction communication wire being used to activate the signal processing unit from the control unit for detection of a first combustion related parameter, and to transfer information concerning the first combustion related parameter from the ignition module to the control unit, the activation and the transfer of information being sequential and synchronous with the inducement of the ignition spark initiated by the control unit and the bi-directional communication on the wire being conducted in digital form, the start of detection being initiated by the transfer from a first digital signal level to a second digital signal level, and the duration of the detection being directly proportional to the pulse width of the digital signal at the second digital signal level, whereby the detection is terminated by the transfer from the second digital signal level to the first digital signal level, and where information concerning the first combustion related parameter is transferred at a different time than the activation of the detection by means of a pulse having a pulse width which is proportional to the first combustion parameter's magnitude.

8. A process in accordance with claim 7, wherein the transfer of the information concerning the magnitude of the first combustion related parameter is sent essentially synchronously with switching of the primary switch to a conductive state by the control unit, and the detection starts after the primary switch has been switched to a non-conductive state which induces an ignition spark in the spark plug gap whereby combustion is initiated.

* * * * *